US009744774B2

(12) United States Patent
Nishi et al.

(10) Patent No.: US 9,744,774 B2
(45) Date of Patent: Aug. 29, 2017

(54) THERMAL PRINT HEAD AND THERMAL PRINTER

(71) Applicant: ROHM CO., LTD., Kyoto (JP)

(72) Inventors: Koji Nishi, Kyoto (JP); Tadashi Yamamoto, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 15/384,930

(22) Filed: Dec. 20, 2016

(65) Prior Publication Data

US 2017/0182793 A1 Jun. 29, 2017

(30) Foreign Application Priority Data

Dec. 25, 2015 (JP) ..... 2015-254498

(51) Int. Cl.
*B41J 2/335* (2006.01)

(52) U.S. Cl.
CPC ..... *B41J 2/3353* (2013.01); *B41J 2/3351* (2013.01)

(58) Field of Classification Search
CPC ..... B41J 2/335; B41J 2/33505; B41J 2/3351; B41J 2/33515; B41J 2/33525; B41J 2/3353; B41J 2/3354; B41J 2/3352; B41J 2/33535; B41J 2/33545
See application file for complete search history.

(56) References Cited

U.S. PATENT DOCUMENTS 4,968,996 A * 11/1990 Ebihara ..... B41J 2/33515 347/202
5,099,257 A * 3/1992 Nakazawa ..... B41J 2/3353 347/201
5,978,007 A * 11/1999 Sawano ..... B41J 2/33515 347/202
6,339,443 B1 * 1/2002 Nakanishi ..... B41J 2/3357 347/200
2008/0143810 A1 * 6/2008 Morikawa ..... B41J 2/33585 347/209

FOREIGN PATENT DOCUMENTS

JP 62-097863 * 5/1987
JP 2013248756 12/2013

* cited by examiner

*Primary Examiner* — Huan Tran
(74) *Attorney, Agent, or Firm* — Hamre, Schumann, Mueller & Larson, P.C.

(57) ABSTRACT

The present invention provides a thermal print head and a thermal printer that can deliver improved printing quality. The thermal print head includes a main substrate with a main surface, heating elements arranged along a main scanning direction, and a protection layer that covers the heating elements. A belt-shaped heating glaze layer is between the main surface and the heating elements, extends along the main scanning direction, and bulges towards the direction where the main surface faces. The surface shape of the protection layer has an equivalent radius of curvature Re between 6200 μm and 15000 μm. The equivalent radius of curvature Re is calculated by Hq and Wq. Hq is ¼ of the maximum height Hm of the bulging portion of the protection layer including the heating glaze layer. Wq is the width of the bulging portion along a sub-scanning direction, measured at a height equal to Hm minus Hq.

24 Claims, 6 Drawing Sheets

THERMAL PRINT HEAD AND THERMAL PRINTER

BACKGROUND

This invention is related to a thermal print head and a thermal printer.

A thermal print head is the main device of a thermal printer, which conducts printing on media such as thereto-sensitive paper. Patent Literature 1 discloses an example of a conventional thermal print head. For the thermal print head disclosed in Patent Literature 1, a resistor layer and an electrode layer are deposited on a substrate. By patterning the resistor layer and the electrode layer, several heating elements are arranged along the main scanning direction of the resistor layer. Moreover, an insulating protection layer covers the resistor layer and the electrode layer. The protection layer prevents damage to the electrode layer or the resistor layer that can be caused by friction between the thermo-sensitive paper and the electrode layer or the resistor layer.

An improper engagement between the thermal print head and thermo-sensitive paper degrades the printing quality. For example, light print may occur if the pressing force between the thermal print head and the thermo-sensitive paper is insufficient. In addition, the installation precision of the thermal print head onto a thermal printer is another factor affecting print quality.

PRIOR TECHNICAL LITERATURE

[Patent Literature 1] Japanese Patent No. 2013248756.

BRIEF SUMMARY OF THE INVENTION

Problems to be Solved in the Present Invention

This invention provides a thermal print head and a thermal printer that can improve the printing quality.

Technical Means for Solving Problems

The first aspect of the present invention proposes a thermal print head comprising a main substrate with a main surface, heating elements that are supported by the main surface and arranged along a main scanning direction, and a protection layer that covers the heating elements. Between the main surface of the main substrate and the heating elements, a belt-shaped heating glaze layer extends along the main scanning direction and increases in thickness towards where the main surface faces, as viewed from the main substrate thickness direction. The surface shape of the protection layer is a curve with an equivalent radius of curvature between 6200 μm and 15000 μm. The equivalent radius of curvature is calculated by two factors: one factor is ¼ of the maximum height of the bulging portion of the protection layer surface covering the heating glaze layer as viewed from the thickness direction; the other factor is the width of the bulging portion of the protection layer surface along a sub-scanning direction measured at a location that is ¼ of the maximum height of the bulging portion below the maximally-bulging portion.

In a preferred embodiment of the present invention, a resistor layer includes the heating elements.

In a preferred embodiment of the present invention, an electrode layer provides power to the heating elements.

In a preferred embodiment of the present invention, the resistor layer is between the main surface of the main substrate and the electrode layer.

In a preferred embodiment of the present invention, the main substrate is ceramics.

In a preferred embodiment of the present invention, the resistor layer is TaSiO2 or TaN.

In a preferred embodiment of the present invention, the electrode layer is Al.

In a preferred embodiment of the present invention, the electrode layer includes individual electrodes respectively extending to each of the heating elements.

In a preferred embodiment of the present invention, the electrode layer has a common electrode with a polarity different than that of the individual electrodes, which correspond to the heating elements.

In a preferred embodiment of the present invention, the common electrode has several junction parts. Each junction part is sandwiched between two adjacent individual electrodes along the main scanning direction, and includes two branches connected to two adjacent heating elements arranged along the main scanning direction.

In a preferred embodiment of the present invention, the electrode layer includes several intermediate electrodes. Each intermediate electrode is connected to two adjacent heating elements, one of which is connected to the individual electrode and one of which is connected to the branch. The intermediate electrode is connected to the heating elements on the side opposite to the branch along the sub-scanning direction.

In a preferred embodiment of the present invention, the intermediate electrodes are disposed within the heating glaze layer area as viewed from the thickness direction.

In a preferred embodiment of the present invention, a sub-substrate is next to the main substrate along the sub-scanning direction. In addition, a driver IC is mounted on the sub-substrate to control heat distribution of the heating elements.

In a preferred embodiment of the present invention, the sub-substrate is glass epoxy resin.

In a preferred embodiment of the present invention, wires connect the electrode layer to the driver IC.

In a preferred embodiment of the present invention, wires are between an edge of the main substrate and an edge of the sub-substrate as viewed from the thickness direction.

In a preferred embodiment of the present invention, sealant covers the wires.

In a preferred embodiment of the present invention, the sealant covers the driver ICs.

In a preferred embodiment of the present invention, an outer connection is connected to the sub-substrate.

In a preferred embodiment of the present invention, the outer connection is flexible circuit board.

In a preferred embodiment of the present invention, a supporter supports the main substrate and the sub-substrate from a side opposite to the main surface.

In a preferred embodiment of the present invention, the supporter is metal.

A second aspect of the present invention proposes a thermal printer. The thermal printer includes the thermal print head proposed by the first aspect of the present invention, and further includes a platen roller that is pressed against the heating elements of the thermal print head and configured to transfer print media.

In a preferred embodiment of the present invention, the radius of the platen roller is between 27 and 65% of the equivalent radius of curvature.

Effects of the Present Invention

The equivalent radius of curvature is between 6200 μm and 15000 μm, and thus the printing quality can be improved.

Other features and advantages of the present invention can be better understood by the following detailed explanation, with reference to the attached drawings.

DETAILED DESCRIPTION

Figure 1:
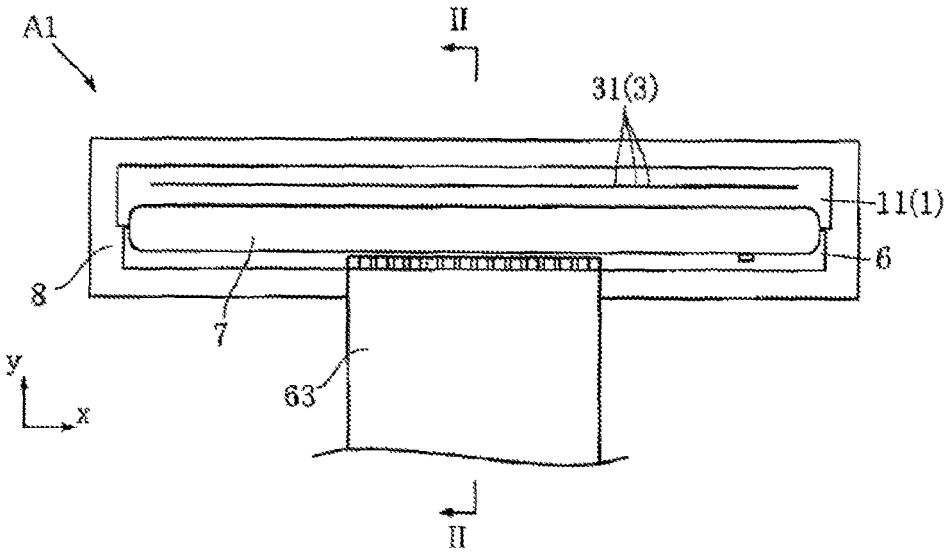
FIG. 1 is a top view of a thermal print head according to the first embodiment of the present invention.

The preferred embodiments of the present invention are specifically discussed below with reference to the drawings.

FIGS. 1 to 5 show a thermal print head and a thermal printer according to the first embodiment of the present invention. In this embodiment, the thermal printer B1 has a thermal print head A1 and a platen roller 91. The thermal print head A1 includes a main substrate 1, a heating glaze layer 2, a resistor layer 3, an electrode layer 4, a protection layer 5, a sub-substrate 6, a driver IC 61, a wire 62, an outer connection 63, sealant 7, and a supporter 8.

Figure 2:
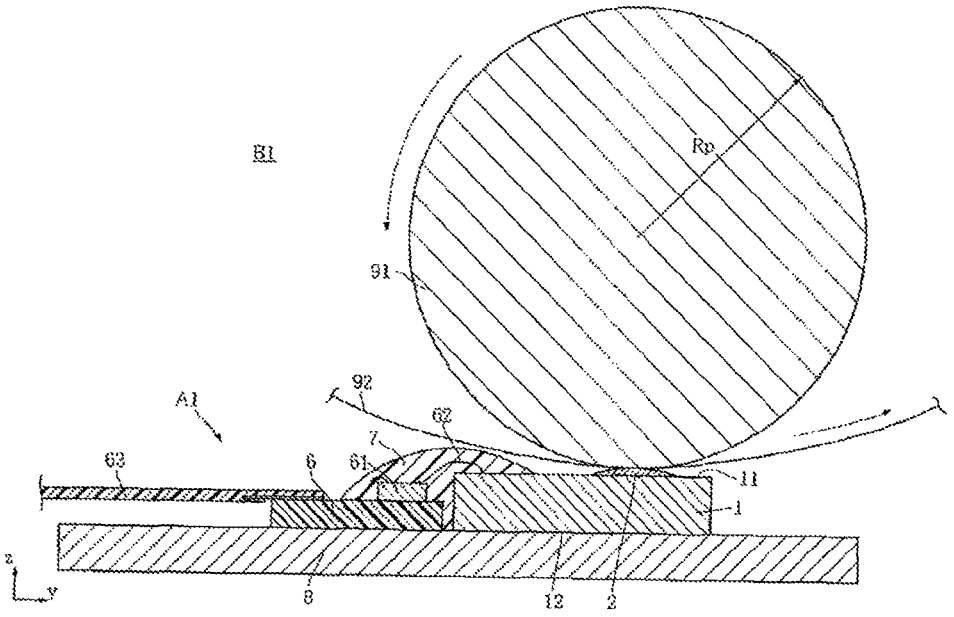
FIG. 2 is a cross-sectional view illustrating the thermal print head and the thermal printer along the line according to the first embodiment of the present invention.
Figure 3:
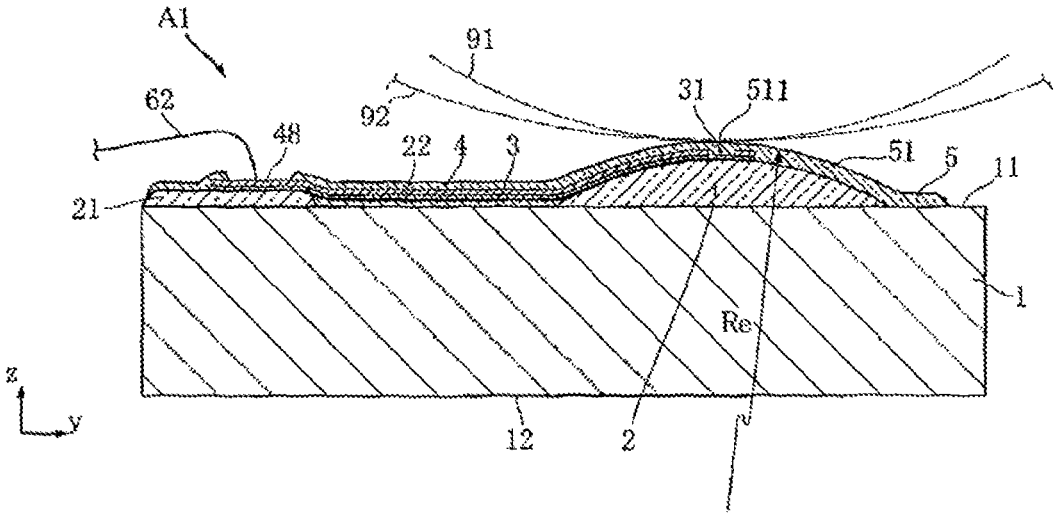
FIG. 3 is an expanded cross-sectional view of the thermal print head according to the first embodiment of the present invention.
Figure 4:
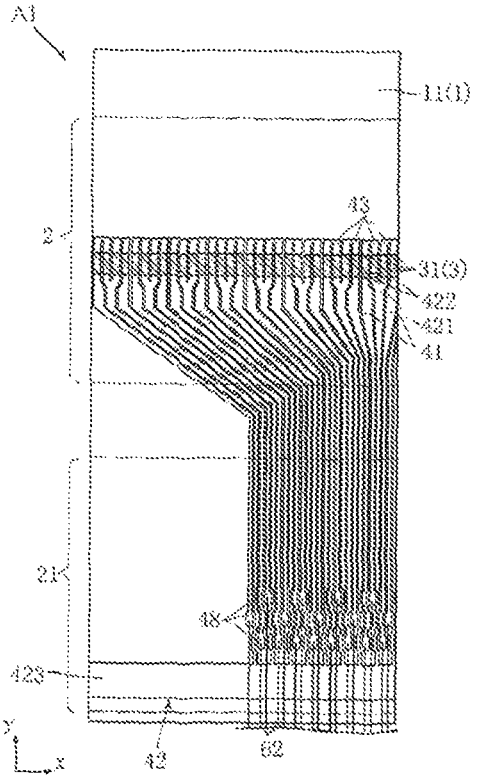
FIG. 4 is a top view of the thermal print head according to the first embodiment of the present invention.
Figure 5:
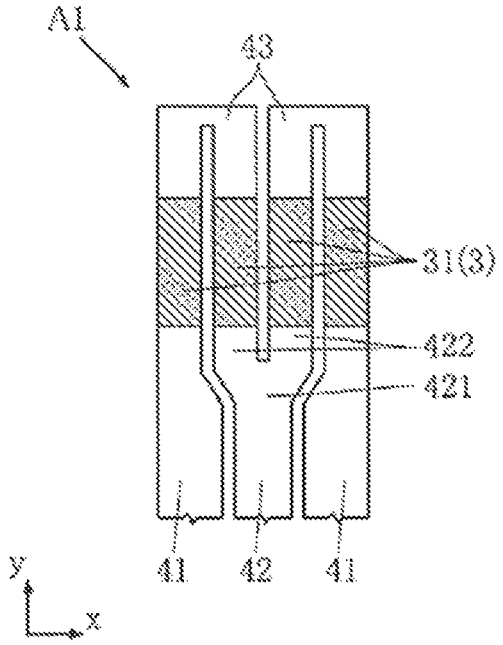
FIG. 5 is an expanded top view of the thermal print head according to the first embodiment of the present invention.

FIG. 1 is a top view of the thermal print head A1. FIG. 2 is a cross-sectional view illustrating the thermal print head A1 and the thermal printer B1 along the line II-II in FIG. 1. FIG. 3 is an expanded cross-sectional view of the thermal print head A1. FIG. 4 is a top view of the thermal print head A1. FIG. 5 is an expanded top view of the thermal print head A1.

The main substrate 1 provides a foundation for the thermal print head A1 and has a surface that is preferably insulating. The material of the main substrate 1 is not limited, but ceramics, such as alumina, are used as examples in the present embodiment. The main substrate 1 is rectangular, with a long side extending along the main scanning direction x. The main substrate 1 also has a main surface 11 and a back side 12 that are opposite each other along a thickness direction z.

The heating glaze layer 2 is formed on the main surface 11 of the main substrate 1, and is of a belt shape extending along the main scanning direction x, as viewed from the thickness direction z. The heating glaze layer 2 is formed in such a way that it increases in thickness towards the direction where the main surface 11 faces (top side of the thickness direction z). The heating glaze layer 2 is glass or similar material.

This embodiment also has a bonding glaze layer 21 and an auxiliary glass layer 22 formed on the main surface 11. The bonding glaze layer 21 is spaced apart from the heating glaze layer 2 in a sub-scanning direction y. The bonding glaze layer 21 can be of a belt shape extending along the main scanning direction x. The bonding glaze layer 21 is glass or similar material. The auxiliary glass layer 22 covers the area between the heating glaze layer 2 and the bonding glaze layer 21 on the main surface 11. The thickness of the auxiliary glass layer 22 is less than the maximum thickness of the heating glaze layer 2. The auxiliary glass layer 22 can be made of glass materials with a firing temperature lower than that of the glass materials of the heating glaze layer 2 and the bonding glaze layer 21.

The resistor layer 3 is supported by the main surface 11 of the main substrate 1. In this embodiment, the resistor layer 3 is formed on the heating glaze layer 2, the bonding glaze layer 21, and the auxiliary glass layer 22. The resistor layer 3 has several heating elements 31. The heating elements 31 are arranged along the main scanning direction x, and provide heat to the print media 92 in situations where the thermal print head A1 (thermal printer B1) is used for printing. The materials for the resistor 3 can be, for example, TaSiO2 or TaN. There is no specific restriction on the thickness of the resistor 3, but as an example the thickness can be between 0.05 μm and 0.2 μm.

The electrode layer 4 is deposited on the resistor layer 3, and is made of materials having a lower resistance than the resistor layer 3. The material of the electrode 4 is not limited to Aluminum, but can alternatively be Cu or Au. There is no specific restriction on the thickness of the electrode layer 4, but as an example the thickness can be between 0.5 μm and 2 μm.

In one embodiment, the entire electrode layer 4 is formed on the resistor layer 3. The electrode layer 4 reveals some parts of the resistor layer 3. The exposed parts of the resistor layer 3, which is under the electrode layer 4, consist of several heating elements 31.

As shown in FIGS. 4 and 5, the electrode layer 4 in one embodiment has several individual electrodes 41, a common electrode 42, and several intermediate electrodes 43.

The individual electrodes 41 are arranged along the main scanning direction x, with each individual electrode having a belt shape and extending along the sub-scanning direction y. Heating elements 31 are exposed in the upper parts (along the sub-scanning direction y in the Figures) of the individual electrodes 41. With this arrangement, the individual electrodes 41 are connected to the heating elements 31.

The common electrode 42 is set to have different polarity than the individual electrodes 41. The common electrode 42 has several junction parts 421. Each junction part 421 is sandwiched between two adjacent individual electrodes 41.

A junction part 421 has two branches 422. The two branches 422 are connected to two adjacent heating elements 31.

Each of the intermediate electrodes 43 is connected to two heating elements 31, one of which is connected to an individual electrode 41 and one of which is connected to a branch 422. The intermediate electrodes 43 are connected to the heating elements 31 from the side opposite the branch 422 along the sub-scanning direction y. The intermediate electrodes 43 are arranged in a reverse-C shape ("⊃") as viewed from the thickness direction z. In this embodiment, all intermediate electrodes 43 are within the area of the heating glaze layer 2 as viewed from the thickness direction z.

With this arrangement, if any of the individual electrodes 41 is set to be in a conducting state, the conduction path that is formed by the particular individual electrode 41; the heating element 31; the intermediate electrode 43; the adjacent heating element 31, and the branch 422 will also be in a conducting state. As a result, the two heating elements 31 within the conduction path will generate heat.

Each individual electrode 41 has a wire bonding part 48. The wire bonding parts 48 are opposite to the heating elements 31 along the sub-scanning direction y. In this embodiment, the wire bonding parts 48 are formed on the bonding glaze layer 21. The wire bonding parts 48 are wider along the main scanning direction x than along other directions.

As shown in FIG. 4, the common electrode has a belt part 423. The belt part 423 is located under the wire bonding parts 48 in the sub-scanning direction y, and extends along the main scanning direction x. The junction parts 421 are connected to the belt part 423 in order to conduct with each other.

The protection layer 5 covers the heating elements 31 and is used to protect the heating elements 31. In this embodiment, the protection layer 5 covers almost all of the resistor layer 3 and the electrode layer 4. The wire bonding parts 48 are exposed through the protection layer 5. The protection layer 5 may contain an insulating layer made of materials such as glass. The insulating layer is in direct contact with the resistor layer 3 and the electrode layer 4. The material of the insulating layer can be SiO2. There is no specific restriction on the thickness of the insulating layer, but as an example the thickness of the insulating layer can be between 0.6 μm and 2.0 μm. Moreover, the protection layer 5 can also have a conducting layer deposited on the aforementioned insulating layer. The materials of the conducting layer can be C/SiC, SiN or SiALON. There is no specific restriction on the thickness of the conducting layer, but the thickness can be, for example, between 4.0 μm and 6.0 μm.

As the aforementioned structure indicates, the shape of the protection layer 5 is determined by the main substrate 1, the bonding glaze layer 21, the resistor layer 3, and the electrode layer 4. In particular, the outline shape of the protection layer 5 is mostly determined by the bonding glaze layer 21. Therefore, when viewed from the thickness direction z, the protection layer surface 51 increases in thickness towards the direction where the main surface 11 faces in areas where the protection layer surface 51 is overlapped by the bonding glaze layer 21. Within the protection layer surface 51, the part most separated from the main surface 11, in the thickness direction z, is the maximally-bulging portion 511.

The sub-substrate 6 is located next to the main substrate 1 along the sub-scanning direction y. The sub-substrate 6 is rectangular with a long side extending along the main scanning direction x. The sub-substrate 6 has a matrix made of materials such as glass epoxy resin, on which a circuit layer is formed.

The driver IC 61 controls the heat distribution and the heating timing of the heating elements 31 by selectively providing current to the heating elements 31. In the present embodiment, several driver ICs 61 are arranged on the sub-substrate 6. Some wires 62 are bonded to the driver ICs 61. When viewed from the thickness direction z, the wires are positioned between an edge of the main substrate 1 and an edge of the sub-substrate 6, and are bonded to the bonding parts 48 on the individual electrodes 41 on the electrode layer 4. Moreover, the driver ICs 61 can be connected to any appropriate locations on the aforementioned circuit layer with other wires.

The outer connection 63 is connected with the sub-substrate 6, and is used for the electrical connection with control units (illustration omitted) and power units (illustration omitted) of the thermal printer B1 when installing the thermal print head A1 onto the thermal printer B1. The structure of the outer connection 63 is not limited, although a flexible circuit board is used as an example in the drawing.

In the present embodiment, sealant 7 covers the wires 62 and the driver IC 61. Black resin can be an example of the material for the sealant 7.

The supporter 8 supports the main substrate 1 and the sub-substrate 6. The material of the supporter 8 is not limited, and metals such as Fe or Al are used in the present embodiment. The shape of the supporter 8 in FIG. 1, as viewed from the thickness direction z, is merely an example. The shape and size of the supporter 8 are not limited.

The platen roller 91 on the thermal printer B1 is used to transfer the print media 92. The platen roller 91 has a surface made of materials such as rubber or resin, and is cylinder-shaped with an axis extending along the main scanning direction x. The platen roller 91 in the present embodiment has a radius Rp of 4 mm.

Figure 6:
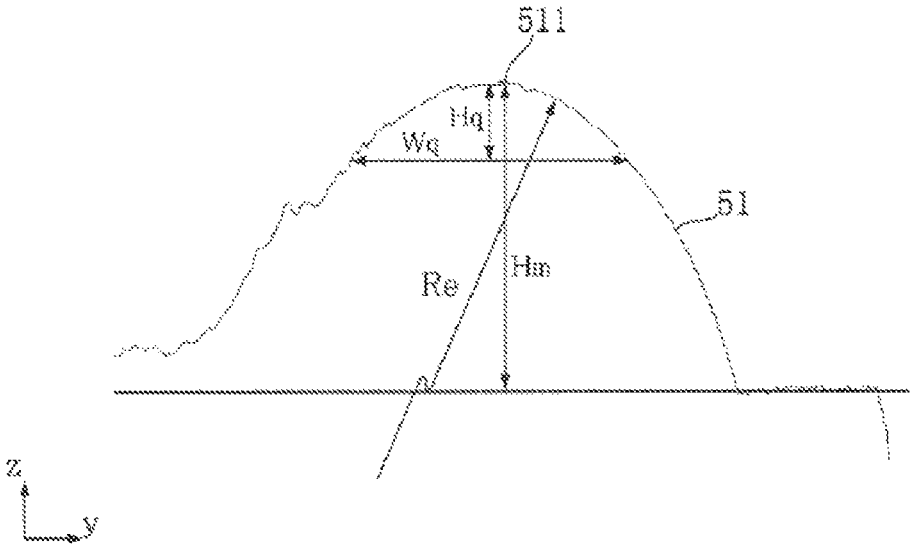
FIG. 6 is a measurement example of the bulging portion of the thermal print head, according to the first embodiment of the present invention.
Figure 7:
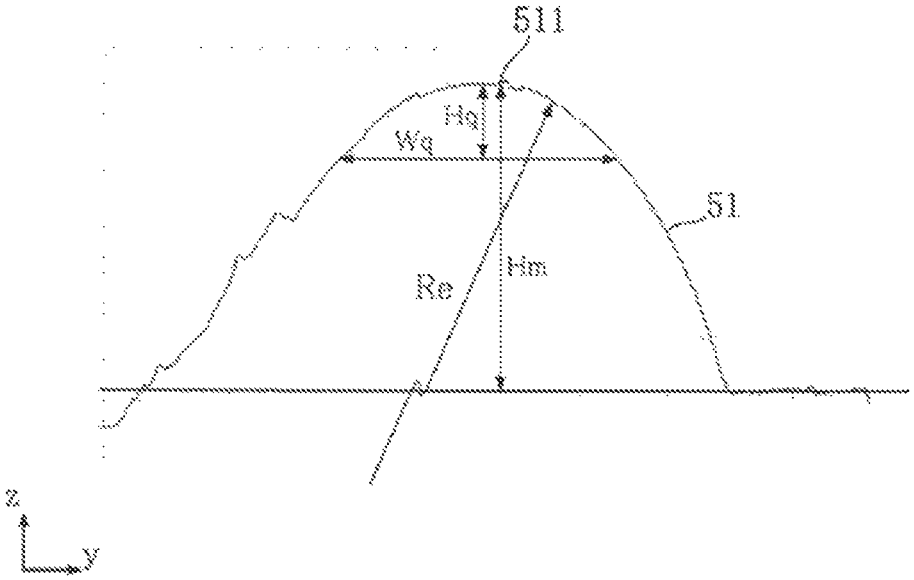
FIG. 7 is another measurement example of the bulging portion of the thermal print head, according to the first embodiment of the present invention.
Figure 8:
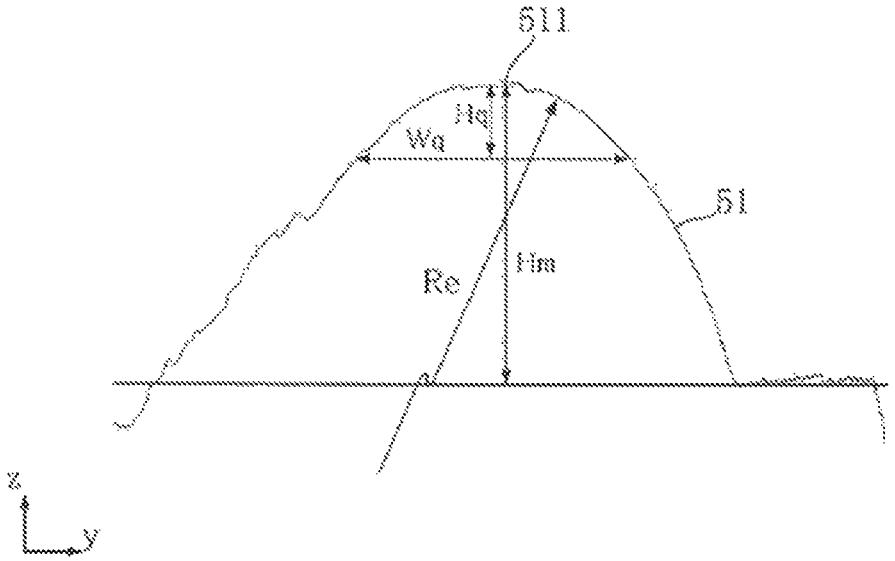
FIG. 8 is another measurement example of the bulging portion of the thermal print head, according to the first embodiment of the present invention.

FIGS. 6 to 8 are measurement results of the protection layer surface 51 of the thermal print head A1. A contact-type surface profile measuring gauge was used in the measurement. These figures trace along the same direction as that in FIG. 3 along the sub-scanning direction y. To provide a clear illustration, the scale along the thickness direction z is enlarged 20 times over that along the sub-scanning direction y.

As shown in FIG. 6, a portion of the protection layer surface 51 increases in thickness upwards along the thickness direction z due to the bulging shape of the heating glaze layer 2. Farther along the protection layer surface 51, a relatively flat portion shaped by the main surface 11 is adjacent to the heating glaze layer 2 along the sub-scanning direction y. The maximally-bulging portion 511 is the area most separated from the main surface 11 along the thickness direction z within the protection surface 51. The maximum height Hm is the height from the aforementioned flat portion within the protection layer surface 51 to the maximally-bulging portion 511. The height Hq is equal to ¼ of the maximum height Hm. The width Wq of the protection layer surface 51 is measured along the sub-scanning direction y, at a height equal to the maximum height Hm (at the point of maximally-bulging portion) minus the distance Hq.

The protection layer surface 51 has a gently bulging shape outlined by the heating glaze layer 2. If the area containing the maximally-bulging portion 511 within the protection layer surface 51 is assumed to be a circular arc, the equivalent radius of curvature Re of the virtual radius of curvature is defined by the following expression:

$$Re = \frac{Hq^2 + (Wq/2)^2}{2Hq}$$

In the example shown in FIG. 6, the maximum height Hm is 54.8 μm, the ¼ height Hq is 13.7 μm, the ¼ width Wq is 970 μm, and the equivalent radius of curvature Re is 8592 μm. In the example shown in FIG. 7, the maximum height Hm is 54.1 μm, the ¼ height Hq is 13.5 μm, the ¼ width Wq is 959 μm, and the equivalent radius of curvature Re is 8522 μm. In the example shown in FIG. 8, the maximum height Hm is 54.1 μm, the ¼ height Hq is 13.5 μm, the ¼ width Wq is 955 μm, and the equivalent radius of curvature Re is 8451 μm.

Figures 9, 10, 11, 12, 13, 14:
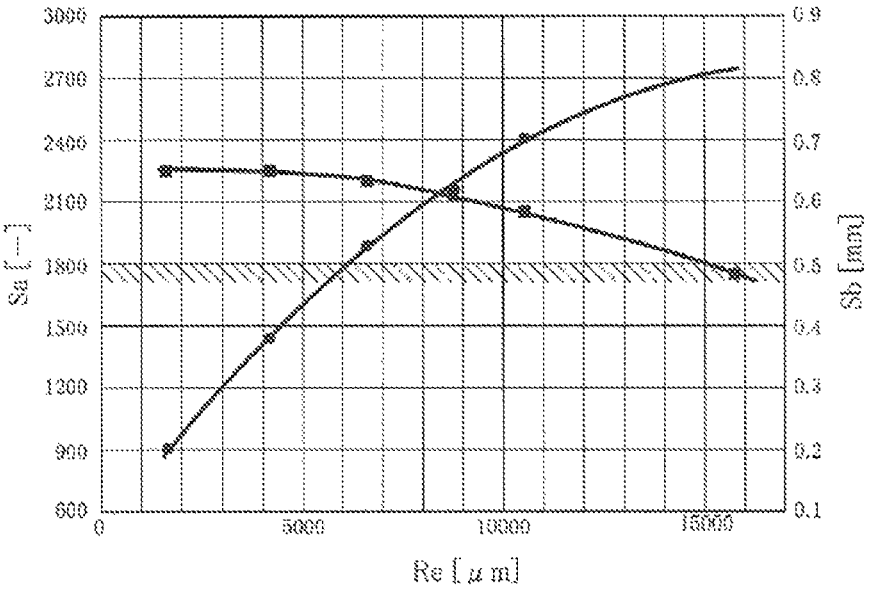
FIG. 9 shows the relation between the equivalent radius of curvature and the printing quality.
FIG. 10 is a top view of a good printing example.
FIG. 11 is a top view of a bad printing example.
FIG. 12 is a top view of a bad printing example.
FIG. 13 is a top view of a good printing example.
FIG. 14 is a top view of a bad printing example.

FIG. 9 shows the relationship between the equivalent radius of curvature Re, the printing quality indicator Sa, and the allowable shift amount Sb. Black square marks are the printing quality indicators Sa, and black circle marks are the allowable shift amounts Sb.

The printing quality indicator Sa is an indicator that quantifies the printing quality with a given standard when printing on the print media 92. FIG. 10 shows a printing example where the printing quality indicator Sa is equal to or greater than 1800. FIG. 11 shows a printing example where the printing quality indicator Sa is less than 1800. The dots in each printing example are the printing dots corresponding to the heating elements 31. In the printing example shown in FIG. 10, the printing dots are printed with appropriate sizes and thickness. The sizes of the printing dots have slight variation, and spaces between adjacent printing dots are small. In the printing example shown in FIG. 11, the printing dots are smaller than those in FIG. 10 and have more variation than those in FIG. 10. Spaces between adjacent printing dots are visible in FIG. 11.

FIG. 10 shows a case in which the heating elements 31 of the thermal print head A1 are pressed against the platen roller 91 with a suitable force. FIG. 11 shows a case in which the pressing force of the platen roller 91 against the heating elements 31 is insufficient. The pressing force of the platen roller 91 tends to be greater when the equivalent radius of curvature Re of the protection layer surface 51 is smaller, while the pressing force of the platen roller 91 tends to be lesser with a larger equivalent radius of curvature Re. Thus, in FIG. 9, the printing quality indicated by the indicator Sa decreases as the equivalent radius of curvature Re increases. To maintain a printing quality indicator Sa greater than 1800, which is the threshold of the allowable range, the equivalent radius of curvature Re needs to be smaller than 15000 μm. In such case, the radius Rp (4 mm) of the platen roller 91 is greater than 27% of the equivalent radius of curvature Re.

To provide satisfactory printing results, the allowable shift amount Sb is the allowable shift amount between the center axis of the platen roller 91 and the maximally-bulging portion 511 along the sub-scanning direction y. FIG. 13 shows an example where the center axis of the platen roller 91 matches the maximally-bulging portion 511 along the sub-scanning direction y. FIG. 12 shows an example where the maximally-bulging portion 511 is shifted 0.3 mm away from the center axis of the platen roller 91 on one side along the sub-scanning direction y. FIG. 14 shows an example where the maximally-bulging portion 511 is shifted 0.3 mm away from the center axis of the platen roller 91 on the other side along the sub-scanning direction y. The example in FIG. 13 has good printing dots, while the examples in FIG. 12 and FIG. 14 have unclear printing dots due to inadequate pressing force between the platen roller 91 and the heating elements 31.

To provide satisfactory printing quality, such as in the example in FIG. 13, FIG. 9 shows the allowable shift amounts Sb with different equivalent radiuses of curvature Re. From the figure it can be seen that the allowable shift amount Sb tends to be greater as the equivalent radius of curvature Re becomes greater. Installation precision of a thermal print head onto a thermal printer is a factor affecting the shift between the center axis of the platen roller 91 and the maximally-bulging portion 511 along the sub-scanning direction y. If the allowable shift amount Sb is set to be 0.5 mm, which is a practical value for the installation precision of a thermal print head, then the equivalent radius of curvature needs to be greater than or equal to 6200 μm. In that case, the radius Rp (4 mm) of the platen roller 91 is equal to or less than 65% of the equivalent radius of curvature Re.

The operations of the thermal print head A1 and the thermal printer B1 are explained as below.

This embodiment shows while the equivalent radius of curvature Re is greater than or equal to 6200 μm, and with the installation precision of the thermal print head A1 equal to or less than 0.5 mm, the platen roller 91 can apply appropriate pressure on the heating elements 31, delivering a printing result that is as good as that shown in FIG. 13. Moreover, with the equivalent radius of curvature equal to or less than 15000 μm, the pressure force between the platen roller 91 and the heating elements 31 can be adequately enhanced, delivering a printing result that is as good as that shown in FIG. 10. Thus the thermal print head A1 and the thermal printer B1 can improve the printing quality.

To improve the printing quality, it is preferred that the radius Rp of the platen roller 91 is between 27 and 65% of the equivalent radius of curvature Re.

To suppress the unevenness of the protection layer surface 51 of the protection layer 5, it is preferable to deposit the resistor layer 3 and the electrode layer 4 on the heating glaze layer 2.

The individual electrodes 41, the junction parts 421, and the intermediate electrodes 43 all sandwich the heating elements 31, and are arranged separated from one another. With such arrangement, there is no overlap between the heating elements 31 and the electrode layer 4 as viewed from the main scanning direction x. Thus, the belt part of the protection layer surface 51, which overlaps the heating elements 31 when viewed from the thickness direction z and extends along the main scanning direction x, is relatively flat. This flat portion is suitable for uniformly pressing the protection layer 5 (specifically, the protection layer surface 51) along with the heating elements 31 to the platen roller 91.

The auxiliary glass layer 22 is arranged to prevent the resistor layer 3 and the electrode layer 4 from forming directly on the boundary between the heating glaze layer 2 and the main surface 11. Compared with the boundary between the heating glaze layer 2 and the main surface 11, the boundary between the auxiliary glass layer 22 and the heating glaze layer 2 is easier to make smooth. This can help prevent cracks in the resistor layer 3 and the electrode layer 4.

Figure 15:
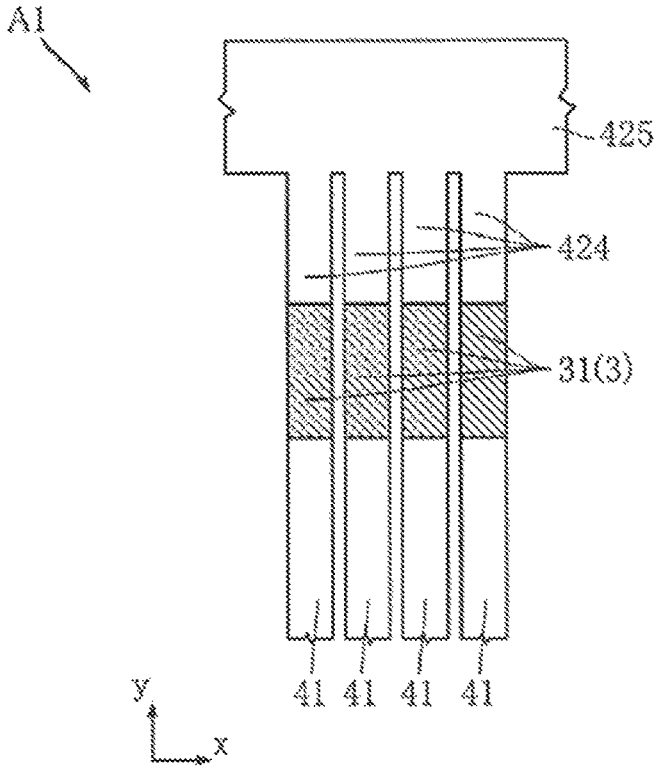
FIG. 15 is an expanded top view of a variation of the thermal print head, according to the first embodiment of the present invention.
Figure 16:
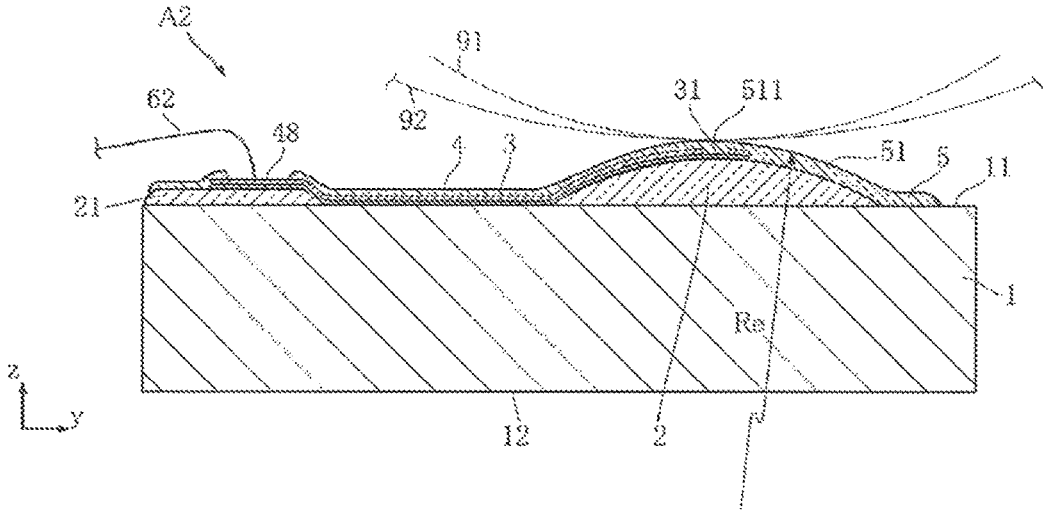
FIG. 16 is an expanded cross-sectional view of the thermal print head according to the second embodiment of the present invention.

FIGS. 15 and 16 show a variation and another embodiment of the present invention, with notations from the earlier embodiment used for identical or similar elements.

FIG. 15 shows an expanded top view of a variation of the thermal print head A1. In this variation, the individual electrodes 41 do not have the common electrode 42 between them and are arranged along the main scanning direction x. The common electrode 42 has several comb-teeth parts 424 and a belt part 425.

The comb-teeth parts 424 are bridged to the individual electrodes 41 by heating elements 31 along the sub-scanning direction y. Each comb-teeth part 424 extends along the sub-scanning direction y and connects to a heating element 31. The belt part 425, arranged on the same side as the comb-teeth parts 424 with reference to the heating elements 31 along the sub-scanning direction y, is belt-shaped and extends along the main scanning direction x. The comb-teeth parts 424 are connected to the belt part 425.

The belt part 425 can be formed within or outside the range of the heating glaze layer 2, as viewed from the thickness direction z. In addition, there can be a layer of metal, such as Ag, deposited within the belt part 425. By arranging the metal layer, the conduction path can have low resistance and the heat loss due to current transmission can be suppressed.

With a variation such as this, the thermal print head A1 and the thermal printer B1 can deliver improved printing quality.

FIG. 16 shows a thermal print head according to the second embodiment of the present invention. The thermal print head A2 in this embodiment does not have the aforementioned auxiliary glass layer 22. The resistor layer 3 and the electrode layer 4 are formed on the main surface 11 in an area that is sandwiched between the heating glaze layer 2 and the bonding glaze layer 21.

Under this embodiment, the thermal print head A2 and a thermal printer that utilizes the thermal print head A2 can also deliver improved printing quality.

Thermal print heads and thermal printers pertaining to the present invention are not limited to the aforementioned embodiments. The actual structures of all parts of the thermal print heads and the thermal printers pertaining to the present invention can adopt any suitable form.

Structures of the resistor layer and the electrode layer are not limited to the aforementioned structures, as long as they can conduct electricity to a plurality of heating elements. Moreover, there can be an electrode layer between the resistor layer and the main surface of the main substrate.

What is claimed is:

1. A thermal print head, comprising:

a main substrate with a main surface;

a plurality of heating elements supported by the main surface and arranged along a main scanning direction;

a protection layer covering the plurality of heating elements;

a belt-shaped heating glaze layer between the main surface of the main substrate and the plurality of heating elements, and extending along the main scanning direction and bulging towards the direction where the main surface faces, as viewed from the main substrate thickness direction;

wherein the protection layer has a surface shaped with an equivalent radius of curvature between 6200 μm and 15000 μm, the equivalent radius of curvature is calculated by, along a thickness direction, a height which is ¼ of a maximum height of a bulging portion of the protection layer including the heating glaze layer, and a width of the bulging portion along a sub-scanning direction measured at a location that is ¼ of the maximum height of the bulging portion from the surface of the maximally-bulging portion.

2. The thermal print head of claim 1, wherein the plurality of heating elements are made with a resistor layer.

3. The thermal print head of claim 2, further comprising an electrode layer providing power to the plurality of heating elements.

4. The thermal print head of claim 3, wherein the resistor layer is between the main surface of the main substrate and the electrode layer.

5. The thermal print head of claim 4, wherein the main substrate is ceramic.

6. The thermal print head of claim 5, wherein the resistor layer is TaSiO2 or TaN.

7. The thermal print head of claim 6, wherein the electrode layer is Al.

8. The thermal print head of claim 4, wherein the electrode layer has a plurality of individual electrodes respectively extending to each of the plurality of heating elements.

9. The thermal print head of claim 8, wherein the electrode layer has a common electrode with a polarity different than that of the plurality of individual electrodes.

10. The thermal print head of claim 9, wherein the common electrode has a plurality of junction parts, and each junction part is sandwiched between two adjacent individual electrodes arranged along the main scanning direction, and has two branches connected to two adjacent heating elements arranged along the main scanning direction.

11. The thermal print head of claim 10, wherein the electrode layer has a plurality of intermediate electrodes, each intermediate electrode is connected to two adjacent heating elements, one of the two adjacent heating elements is connected to one of the plurality of individual electrodes, and the other one of the two adjacent heating elements is connected to one of the two branches, the intermediate electrode is connected to the two adjacent heating elements from the side opposite to the one of the two branches along the sub-scanning direction.

12. The thermal print head of claim 11, wherein the plurality of intermediate electrodes are within the heating glaze layer area as viewed from the thickness direction.

13. The thermal print head of claim 1, further comprising a sub-substrate next to the main substrate along the sub-scanning direction, the sub-substrate is mounted with a driver IC to control heat distribution of the heating elements.

14. The thermal print head of claim 13, wherein the sub-substrate is glass epoxy resin.

15. The thermal print head of claim 13, further comprising a plurality of wires connecting the electrode layer and the driver IC.

16. The thermal print head of claim 15, wherein the plurality of wires are between an edge of the main substrate and an edge of the sub-substrate as viewed from the thickness direction.

17. The thermal print head of claim 16, further comprising sealant covering the plurality of wires.

18. The thermal print head of claim 17, wherein the sealant covers the driver IC.

19. The thermal print head of claim 13, further comprising an outer connection connected to the sub-substrate.

20. The thermal print head of claim 19, wherein the outer connection is flexible circuit board.

21. The thermal print head of claim 13, further comprising a supporter supporting the main substrate and the sub-substrate from a side opposite to the main surface.

22. The thermal print head of claim 21, wherein the supporter is metal.

23. A thermal printer, comprising:

the thermal print head of claim 1;

a platen roller being pressed against the heating elements of the thermal print head and configured to transfer print media.

24. The thermal printer of claim 23, wherein the radius of the platen roller is between 27 and 65% of the equivalent radius of curvature.

* * * * *